United States Patent [19]

Hernandez

[11] Patent Number: 4,783,974

[45] Date of Patent: Nov. 15, 1988

[54] RE-ATTACHABLE BREAK-A-WAY EARRING ORNAMENTS AND NECKLACE

[76] Inventor: Charles Hernandez, 1209 W. Inglewood, Broken Arrow, Okla. 74011

[21] Appl. No.: 69,507

[22] Filed: Jul. 2, 1987

[51] Int. Cl.[4] ..... A44C 7/00; A44C 15/00

[52] U.S. Cl. ..... 63/2; 63/12; 63/29.1

[58] Field of Search ..... 63/14 A, 12, 13, 29 M, 63/29 R, 1.1, 2

[56] References Cited

U.S. PATENT DOCUMENTS

| | | | |
|---|---|---|---|
| 188,323 | 3/1877 | Weed | 63/14 A |
| 1,556,106 | 10/1925 | Hamilton | 63/2 |
| 2,733,578 | 2/1956 | Tucker | 63/29 M |
| 2,752,764 | 7/1956 | Lederer | 63/29 M |
| 3,082,431 | 3/1963 | Watts | 63/1.1 X |
| 3,163,026 | 12/1964 | Kenny | 63/14 A |
| 3,898,868 | 8/1975 | Tomlinson | 63/29 R |
| 4,195,492 | 4/1980 | Johnson | 63/29 M |
| 4,353,225 | 10/1982 | Rogers | 63/29.1 |
| 4,507,344 | 3/1985 | Baughman | 63/29 R |

FOREIGN PATENT DOCUMENTS

| | | | |
|---|---|---|---|
| 3014135 | 10/1981 | Fed. Rep. of Germany | 63/12 |
| 796714 | 6/1958 | United Kingdom | 63/29 R |
| 821026 | 9/1959 | United Kingdom | 63/14.1 |

*Primary Examiner*—Richard J. Johnson
*Attorney, Agent, or Firm*—Head & Johnson

[57] ABSTRACT

An earring ornament is readily detachable from a wear post, which is insertable through a hole in the ear. The post is provided with a male connector on the exterior end. The earring ornament is provided with a female connector which detachably mates with the male connector to provide for a detachable earring. The wear post may be left in the ear and different ornaments attached to the male connector. If the ornament is grabbed or caught it will readily detach from the male connector of the wear post. In another embodiment the ornament is provided with a female necklace connector so that a necklace may be supported from the ear ornaments.

3 Claims, 2 Drawing Sheets

RE-ATTACHABLE BREAK-A-WAY EARRING ORNAMENTS AND NECKLACE

DISCLOSURE STATEMENT

Earrings have been worn for ages and the type which are used with hole in the ear have generally a wear post with a clutch connector for one end and an ornament fixed to the wear post on the outer end. None to my knowledge has an ornament which is completely detachable nor do any of them have a necklace which is attachable to a detachable ear ornament.

Very recently some stores are selling earring models in which means are provided to change the appearance of the ornament part by changing beads or figure which are supported by an ornament base or frame which is larger than the part that is exchangable. The ornament base or frame remains fixed to the wear post. Thus a strong pull on the ornament is likely to injure the ear. This was observed sometime after I had made my invention.

BACKGROUND OF THE INVENTION

This invention relates to earrings and necklaces.

Earrings and necklaces have been worn for centuries by people desiring to improve their appearance. A common way of wearing earrings is to have the ear pierced whereby there is a hole extending through the ear lobe. The earring normally consists of a wear post which is insertable through the hole. On one end of the wear post is fixed an ornament which is exposed to the eye of an observer. The ornament is large in size compared to the wear post. The other end of the wear post is provided with a clutch or other means securing the wear post within the hole to the ear. When one wishes to change the ornament one removes the clutch from the wear post, removes the wear post and ornament from the ear and then uses another clutch and wear post with fixed ornament.

Necklaces are also quite commonly worn about the neck for ornaments. The necklace may be beads, pearls or the like with holes through which a thread or string is run. The necklace may be one piece and may be dropped over the head or it may have a fastener whereby it can just be with two ends and the two ends are fastenable together.

When the ear ornament is caught in clothing or is pulled in some other way there have been numerous instances where the wear post has torn the ear and caused considerable pain and suffering.

SUMMARY OF THE INVENTION

This invention concerns a reattachable break-a-way earring device for use with an ear having a hole pierced therethrough. It includes a wear post, a clutch and an ornament. Construction is such that only a small force, e.g., less than one pound, will cause the complete ornament to break clearly from the wear post.

A wear post is insertable through the hole in the ear lobe. One end of the wear post is provided with a clutch which would be on the inner side of the ear and is used to hold the wear post in the hole. The other end of the wear post is provided with a small support plate and male connector, the plate and connector may be made as a unit. A reattachable break-a-way earring ornament or dome is provided with a female connector on one side for mating with the male connector. The ornament may be of any material or color as desired. After the wear post has been secured to the ear, the female connector of the ornament is connected to the male connector of the wear post. If it is desired to have a different color or type ornament all that is necessary to do is to remove the detachable ornament from the male connector of the wear post and substitute therefor another ornament of desired material or color. The complete ornament is detachable and when it is detached there is nothing left on the connector of the wear post. The wear post remains attached to the ear. The ornament is secured to the ear, however, if a force is applied to the ornament it will break free from the male connector rather easily so as to prevent any damage to the ear which might be caused if the ornament had been a fixed part of the end of the wear post. None of the ornament will remain on the wear post in my invention.

In still another embodiment of the invention the ornament is provided with a second female connector on the same side as the first female connector that is spaced therefrom. A necklace having two ends with each end having a male connector is provided and the male connector is connected into the female connector of the ornament. Thus, the necklace, instead of going around the neck and being secured at the back is secured to the ornament on each ear and thus extends down from one ear to the neck area and up to the other ear.

In a particularly preferred embodiment, a magnetic attachment is used to detachably attach the ornament to the wear post.

It is thus an object of this invention to provide a novel earring wear post which can be left in the ear lobe and various earring ornaments can be selected and detachably attached to the outer end of the wear post.

DETAILED DESCRIPTION OF THE INVENTION

Figure 1:
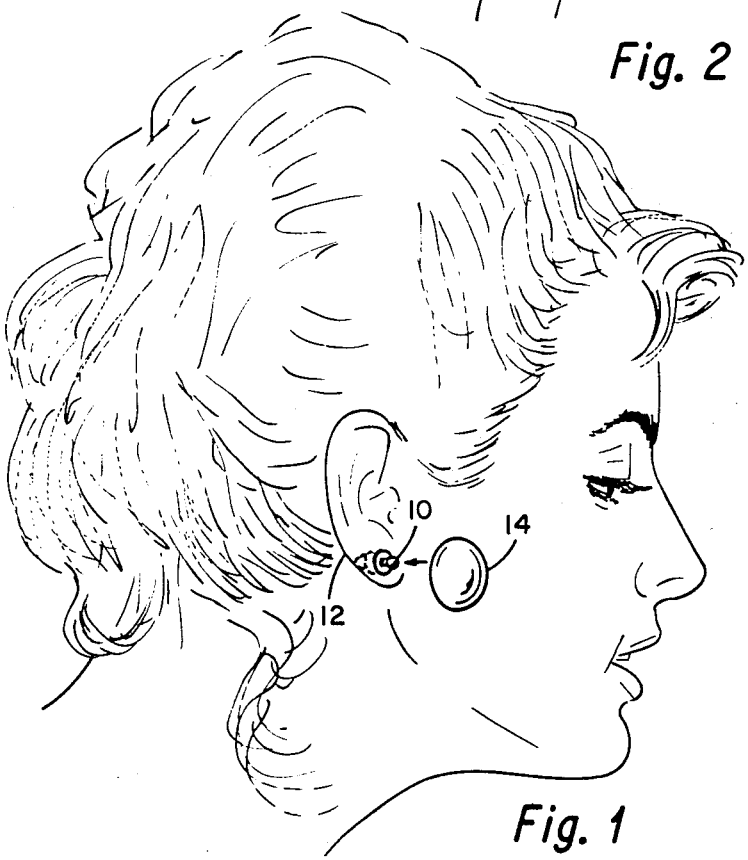
FIG. 1 illustrates the detachable ornament from a wear post in the ear on a person in accordance with my invention.
Figure 3:
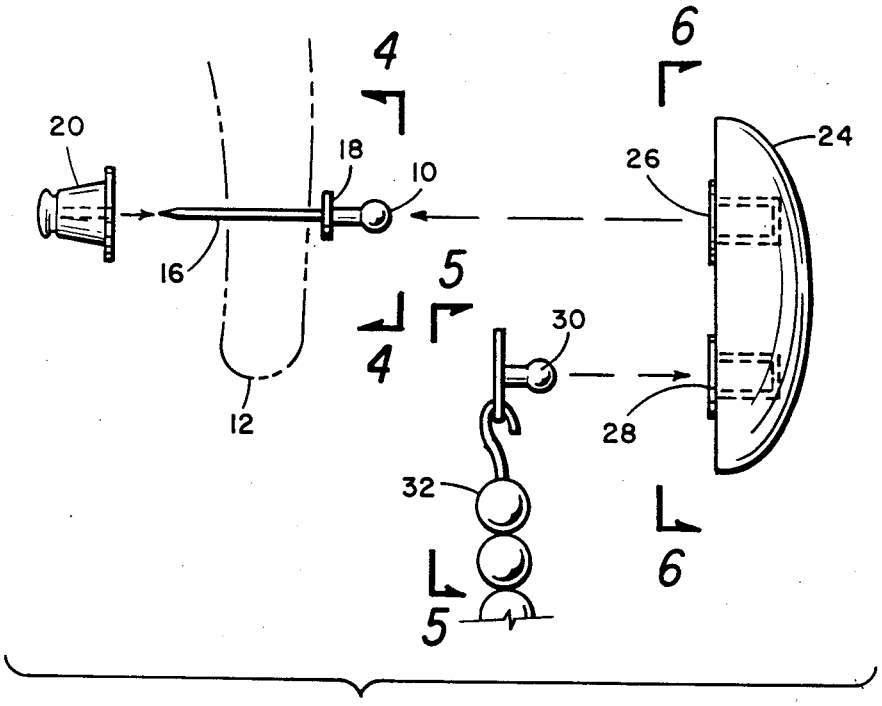
FIG. 3 illustrates in exploded form the detachable earring with detachable ornament and in which the detachable ornament has means for attaching the ends of the necklace.
Figure 4:
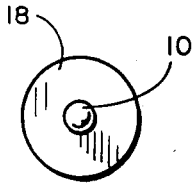
FIG. 4 is a view taken along the line 4—4 of FIG. 3.
Figure 5:
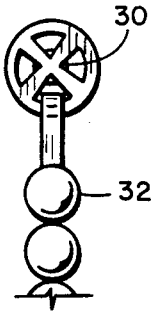
FIG. 5 is a view taken along the line 5–5 of FIG. 3.

Attention is first directed to FIG. 1 which shows a male connector 10 which has a wear post extending through the ear 12 of a lady. Mountable on male connector 10 is an earring ornament or dome 14. This connection of the dome and post is a reattachable break-a-way connector. The break-a-way force required is small enough so as to prevent injury to the ear in nearly all cases if the ornament is subjected to a sudden pull. Attention is now directed to FIG. 3 which shows wear post 16 to which male connector 10 is attached. A support plate 18 is attached to the wear post adjacent the male connector 10. The support plate is very small and should fit flat against the ear lobe. The other end of wear post 16 is provided with a clutch 20 for securing the wear post 16 with the ear 12. Clutch 20 can have a frictional fit over the end of the wear post, or alternatively, other means can be used such as threading the end of wear post 16 and providing complementing threads inside clutch 20.

Figure 7:
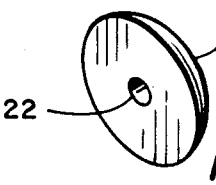
FIG. 7 shows a simple ornament or dome for use with the wear post illustrated in FIG. 3.

Various types of ornaments or domes can be used in connection with male connector 10. The one illustrated in FIG. 1 is essentially the one shown in FIG. 7 which has a female connector 22 which mates with the male connector 10. In use, the wear post 16 is secured in the hole of ear 12 by clutch 20. Then the wearer can select which ornament 14 she wishes to wear. This could be based on selection of colors, selection of materials and so forth. This can be changed without removing the wear post. In fact, the wear post may be left in the ear for long periods of time and by changing the ornament or dome 14 one gives the appearance of changing complete earrings.

If dome 14 should become caught, for example, in a sweater while removing it, the dome would simply break-a-way from the post without causing any damage to the ear. The dome can be very easily reattached. The force required to remove the dome 14 should be small enough to avoid injury to the ear yet large enough to hold the dome to the post in normal wear. This force is typically not over about one-half to one pound.

Figure 2:
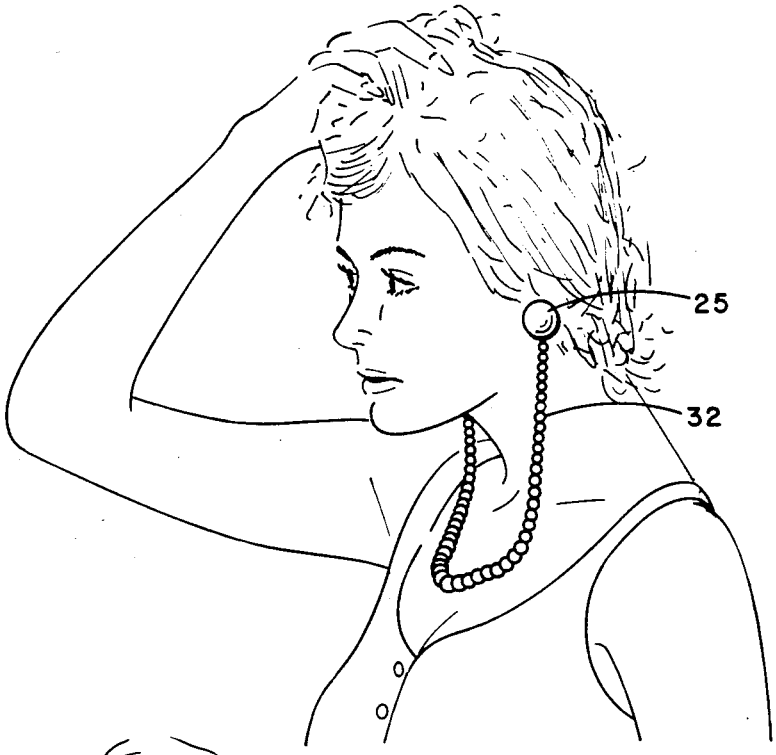
FIG. 2 illustrates a detachable bead being supported from detachable ornaments worn with earrings in accordance with my invention.
Figure 6:
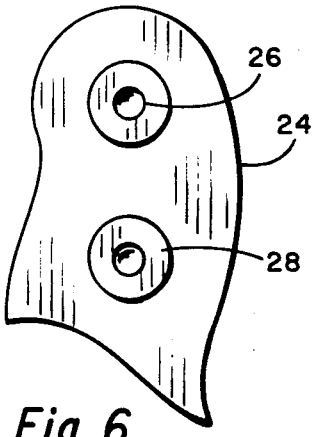
FIG. 6 is a view taken along the line 6—6 of FIG. 3.

Another ornament or dome different from dome 14 is shown in FIG. 3 as element 24. As shown in FIG. 6 ornament 24 has a first female connector 26 which is for use with male connector 10 of the wear post and a second female connector 28. The second female connector 28 is for use with the male connector 30 of a string of beads 32 as shown in FIG. 2. An ornament 25 having two female connectors can be used to support a necklace 32 by securing the male connector 30 of the bead 32 to the female connector 28. The female connectors of dome 25 in FIG. 2 are not shown but can be like connectors 26 and 28 of FIG. 6. The wearing of the earrings and necklace as shown in FIGS. 2 and 3 gives a unique, pleasing appearance not heretofore available. By this arrangement, especially as shown in FIG. 3 if the beads are caught or pulled such as by small child then the ears are protected because the beads break away from the ornament by male connector 30 pulling out of female necklace connector 28. The required break-a-way force would be comparable to that required for connector 10 and connector 26. A double protection and advantage in this embodiment is that the ornament 24 may also be readily detached from male connector 10 of the wear post 16. Either the connector of the bead to the ornament or the connector of the wear post to the ornament gives a safety connection to aid in preventing damage to the ears of the wearer.

Figure 8:
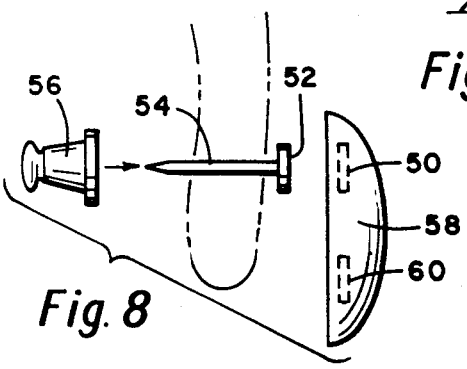
FIG. 8 shows, in exploded form, an earring similar to that of FIG. 1 except the detachable connection is magnetic.

Various other means of attaching the ornament to the post or the necklace may be used but must retain the breakaway ability. A preferred alternative would be the use of magnets having the sufficient strength to hold the ornament to the post or the necklace to the ornament but having a magnetic field weak enough so that a pull on the ornament or the necklace would separate the magnets from each other before tearing the ear. As shown in FIG. 8, one magnet 50 is embedded in a cavity in ornament 58. A core of iron 52 is permanently attached to the wear post 54 which is held in position by clutch 56. A magnet can be used to connect the beads or the necklace 32 of the earring ornament at connector position 60.

The magnet material is preferably defined as semorian cobalt. It could also be neo demnion. Of course the magnet can be in either the ear ornament or on the post and the iron material attached to the one without the magnet. The force required to pull the ornament and post apart is comparable to that discussed above for mechanical attachments.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed:

1. A detachable earring device for use with an ear having a hole therethrough which comprises:

a wear post having a first end and a second end and extendable through said ear hole, one end of said wear post having a support plate and a male connector;

a clutch means for attaching to the second end of said wear post to hold it in place on an ear;

an ornament having an aesthetic surface and another surface having a female connector attached thereto for detachably attaching to said male connector;

a second female connector in said ornament on the same side as said first connector;

a chain of beads having a first end and a second end, each end having a male connector for detachably attaching to said second female connector.

2. A device as defined in claim 1 in which a force of not over about five pounds is sufficient to detach the male connector from the female connector.

3. A re-attachable break-a-way earring device for use with an ear having a hole therethrough which comprise:

a wear post having a first and a second end and extendable through said ear hole, said first end of said post having a first connector;

clutch means for attaching to said second end of said post to hold it in place;

an earring ornament having an ornament connector for detachably attaching to said first connector so that the complete ornament is detachably attached to the post;

a second ornament connector; and a string of beads having a first end and a second end, each said end having a connector for detachably attaching to said second ornament connector such that said string of beads has a break-a-way connection with said second ornament connector.

* * * * *